US011206936B2

(12) United States Patent
Lee

(10) Patent No.: US 11,206,936 B2
(45) Date of Patent: Dec. 28, 2021

(54) ADJUSTABLE BED COVERING

(71) Applicant: Jennifer Mirinda Lee, Yuba City, CA (US)

(72) Inventor: Jennifer Mirinda Lee, Yuba City, CA (US)

( * ) Notice: Subject to any disclaimer, the term of this patent is extended or adjusted under 35 U.S.C. 154(b) by 205 days.

(21) Appl. No.: 16/439,057

(22) Filed: Jun. 12, 2019

(65) Prior Publication Data

US 2020/0390252 A1 Dec. 17, 2020

(51) Int. Cl.
*A47G 9/02* (2006.01)

(52) U.S. Cl.
CPC ..... *A47G 9/0207* (2013.01)

(58) Field of Classification Search
CPC .... A47G 9/023; A47G 9/0238; A47G 9/0261; A47G 9/04; A47G 9/0207; A47G 9/0223; A47G 9/08
See application file for complete search history.

(56) References Cited

U.S. PATENT DOCUMENTS 713,329 A * 11/1902 Morton ..... A47G 9/08 5/413 R
917,403 A * 4/1909 Benger ..... A47G 9/08 5/413 R
4,266,308 A 5/1981 Shatz
5,566,411 A 10/1996 Eiler
7,086,102 B1 8/2006 Frazier
9,149,136 B2 10/2015 Mikesell
2012/0167306 A1 7/2012 MacDonald

OTHER PUBLICATIONS

"World's First Adjustable, All-in-One Comforter || One Bed (Canceled)" [online][Retrieved on Jun. 5, 2019]; Retrieved from the Internet URL: https://www.kickstarter.com/projects/rodger/worlds-first-adjustable-all-in-one-comforter-one-b/description?lang=de; 32 pages.

* cited by examiner

*Primary Examiner* — Eric J Kurilla
(74) *Attorney, Agent, or Firm* — Fish & Richardson P.C.

(57) ABSTRACT

A bed covering includes side folding portions that can be folded and fastened by fasteners to remain secured in the folded positions when not in use. When the folding portions of the bed covering are in the folded position, the dimensions of the bed covering are approximately those of a standard-sized bed covering for a particular mattress size (e.g., king, queen, etc.). When the bed covering is in use, the folded portions are unfastened and unfolded, increasing the dimensions of the bed covering, resulting in an oversized bed covering. Accordingly, the aesthetics of a properly-sized bed covering for a particular bed size are not sacrificed by use of the oversized bed covering, as the aesthetics are preserved when the bed covering is in the folded configuration.

12 Claims, 5 Drawing Sheets

ADJUSTABLE BED COVERING

BACKGROUND

Bed coverings, such as comforters and duvets, are typically slightly larger than the standard mattress sizes for which the comforters are designed. For example, a queen sized mattress has a length of 80" and a width of 60". A comforter for a queen-sized mattress has a length of 92" and a width of 96". Likewise, for a standard king-sized mattress, which has a length of 80" and a width of 78", a comforter has a length of 96" and a width of 110". These corresponding sizes may vary by several inches in each dimension for each manufacture.

Typically, the width of the comforter exceeds the width of a mattress for which it is sized at a greater proportion than the length of the comforter exceeds the length of the mattress. This is because a comforter sized for a particular mattress size is designed to overhang the left and right sides of the mattress more than it overhangs the top and bottom sides of the mattress. In particular, a comforter is often sized for a mattress to overhang the left and right sides of the mattress by the thickness of the mattress. A bed skirt is then used to cover the box springs upon which the mattress rests.

While couples are sleeping, it is not uncommon for one of them to pull the bed covering and uncover the other, which can result in a number of problems. For example, assume a couple, Jane and Bob, are sleeping during a cold winter night, and Jane pulls and bundles the comforter so much that Bob becomes uncovered. Bob then becomes cold and wakes up in the middle of the night, and he's slightly annoyed, because Jane has a habit of uncovering him at night. Bob then pulls on the comforter to cover up. However, Jane has a tight grip on the comforter, and Bob thus must pull hard, waking Jane up. Half-asleep bickering then ensues. Come morning, a grumpy Jane and Bob emerge from the bedroom.

One possible solution to this problem is to purchase an oversized comforter for the bed, but this is an inefficient solution. To illustrate, assume Jane and Bob sleep in a queen-sized bed and have just emerged from the bedroom, both in a slightly sleep-deprived grumpy state. Bob, who does not have an eye for detail or a sense of style, proposes buying a king-sized comforter. This causes Jane to roll her eyes at Bob and say "Duh! That's silly! You can't have a king-sized comforter on a queen sized bed. The sides of the comforter will be too low when the bed is made, and it will look sloppy. No way." Bob, being tired, takes offense to Jane's words, and more bickering ensues.

Thus there is a need for oversized comforters that can be adjusted in size, preferably for given mattress sizes.

SUMMARY

This specification relates to a bed covering that can be adjusted in size. The bed covering includes side folding portions that can be folded and fastened to remain secured in the folded positions when not in use. When the folding portions of the bed covering are in the folded position, the dimensions of the bed covering are approximately those of a standard-sized bed covering for a particular mattress size (e.g., king, queen, etc.). When the bed covering is in use, the folded portions are unfastened and unfolded, increasing the dimensions of the bed covering, resulting in an oversized bed covering. Accordingly, the aesthetics of a properly-sized bed covering for a particular bed size are not sacrificed by use of the oversized bed covering, as the aesthetics are preserved when the bed covering is in the folded configuration.

In general, one innovative aspect of the subject matter described in this specification can be embodied in a bed covering, comprising a first portion defining a top edge, a bottom edge, a first folding region and a second folding region, wherein: a length of the first portion is measured from the top edge to the bottom edge, a width of the first portion is measured from the first folding region to the second folding region; and a second portion that has a top edge and bottom edge respectively extending from the top edge and bottom edge of the first portion, and that extends from the first folding region of the bed covering by an extension width and forms a first side edge of the bed covering that is substantially parallel to the first folding region of the bed covering; a third portion that has a top edge and bottom edge respectively extending from the top edge and bottom edge of the first portion, and that extends from the second folding region of the bed covering by the extension width and forms a second side edge of the bed covering that is substantially parallel to the second folding region of the bed covering; wherein at least the second portion and third portions include fasteners that can secure the second portion and third portion in respectively folded positions along the first folding region and the second folding region so that the first folding region forms a first folded edge running from the top edge of the first portion to the bottom edge of the first portion, and the second folding region forms a second folded edge running from the top edge of the first potion to the bottom edge of the first portion, and wherein the first folded edge and the second folded edge are separated by the width of the first portion.

The subject matter may realize one or more of the following advantages. An oversized bed covering may have folded portions secured by fasteners when folded, which facilitates moving the bed covering on the bed without causing the bed covering to become unfolded while making the bed. By securing the folded portions, a relatively straight side edge can be maintained in the bed covering. When the fasteners are cloth loops and cloth ties, or just cloth ties, the fasteners feel much like the material of the bed covering, and thus does not disturb the person using the comforter. The comforter may also be used while in the folded configuration.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements. To avoid congestion in latter drawings, some reference numbers are omitted for elements that have been previously described.

DETAILED DESCRIPTION

Figure 1:
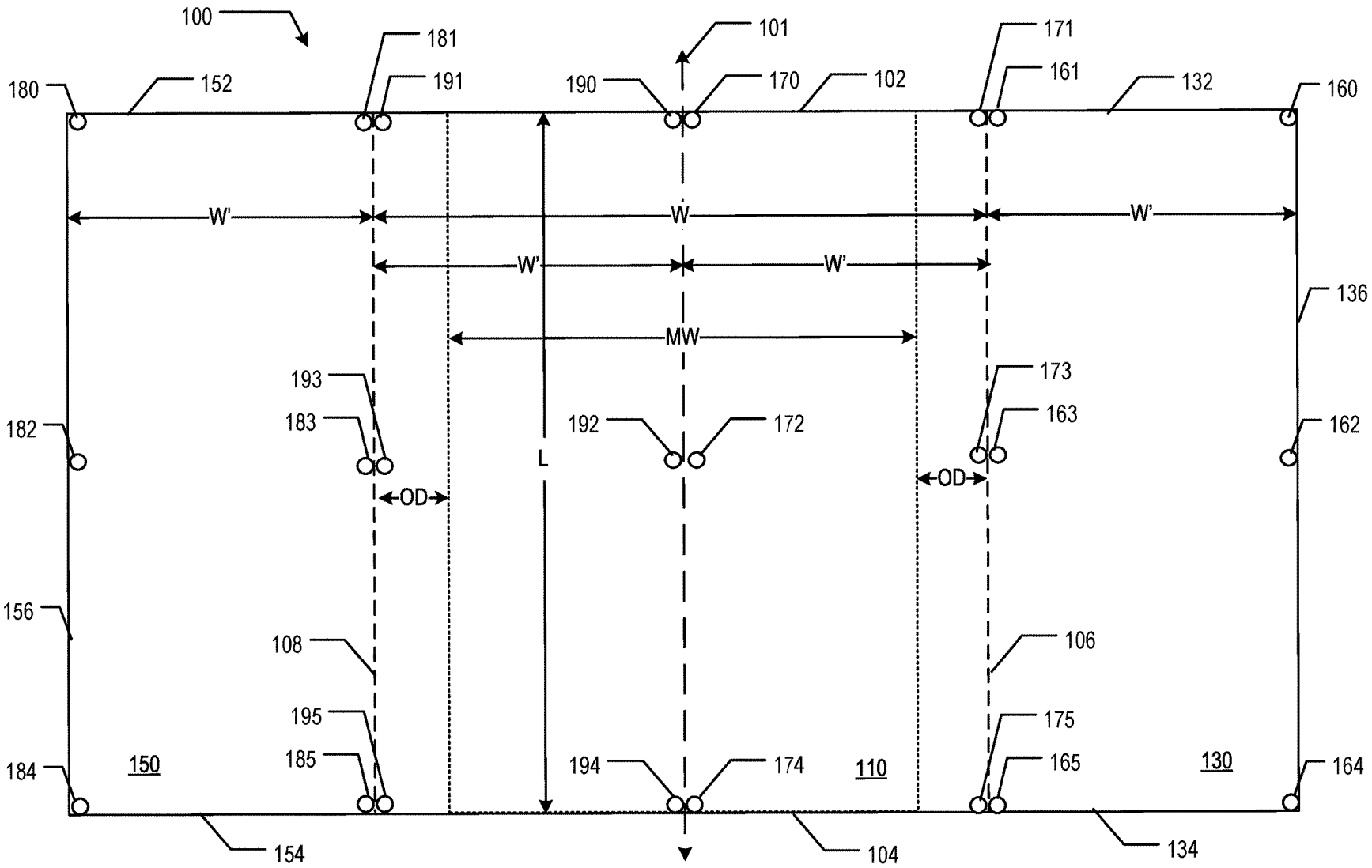
FIG. 1 is a bottom view of an adjustable bed covering.
Figure 2:
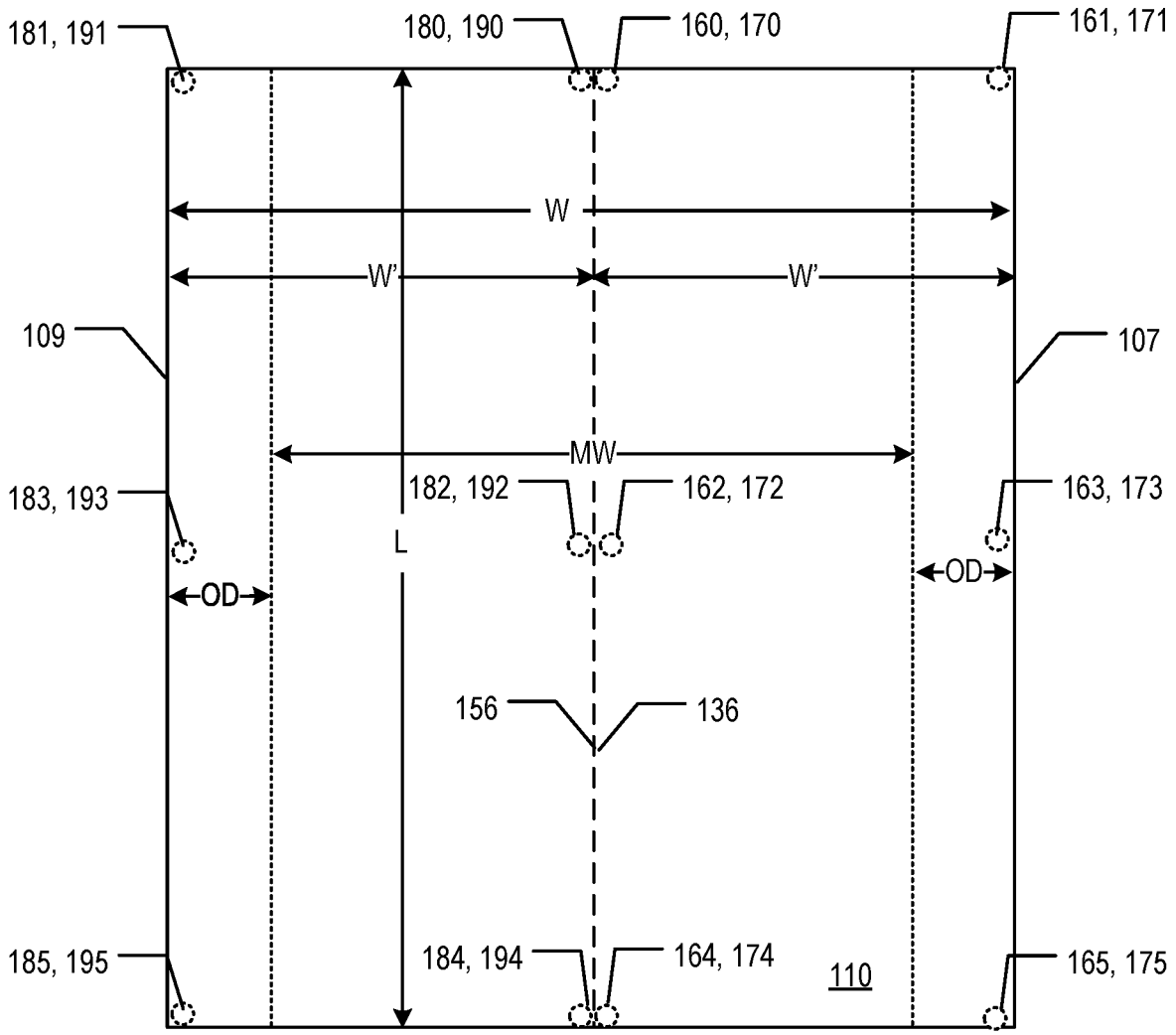
FIG. 2 a top view of the adjustable bed covering of FIG. 1, when the adjustable bed covering is in a folded position.
Figure 3:
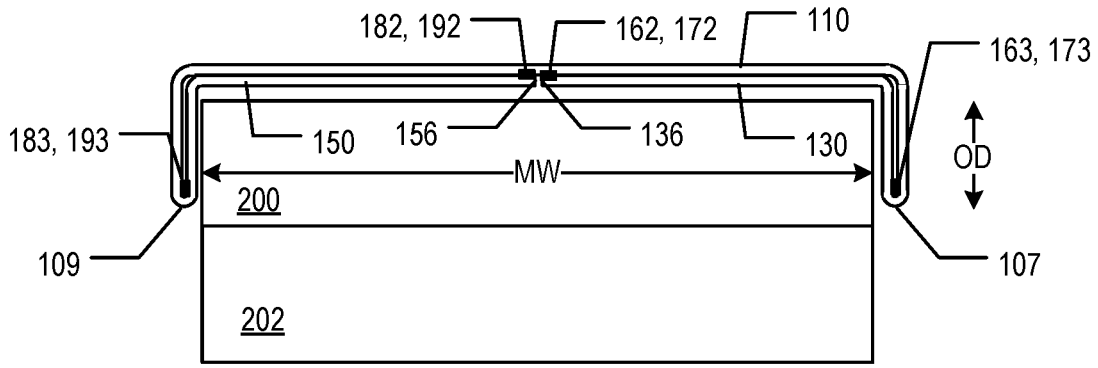
FIG. 3 is a cross-sectional view of the adjustable bed covering of FIG. 1 in a folded position on a mattress and box spring.

FIGS. 1, 2, and 3 are bottom, top and cross-sectional views of an adjustable bed covering 100. The bed covering 100 includes a first portion 110 defining a top edge 102, a bottom edge 104, and a first folding region 106 and a second folding region 108.

At the first folding region 106, represented by the dashed line 106, a second portion 130 extends from the first portion 110. The second portion 130 has a top edge 132, and a bottom edge 134, each respectively extending from the top edge 102 and bottom edge 104 of the first portion 110. In some implementations, the top edges 102 and 132 form a straight edge, as do the bottom edges 104 and 134, as illustrated in FIG. 1.

Likewise, at the second folding region 108, represented by the dashed line 108, a third portion 150 extends from the first portion 110. The third portion 150 has a top edge 152, and a bottom edge 154, each respectively extending from the top edge 102 and bottom edge 104 of the first portion 110. In some implementations, the top edges 102 and 152 form a straight edge, as do the bottom edges 104 and 154, as illustrated in FIG. 1.

In some implementations, the first portion 110 has a length L measure from the top edge 102 to the bottom edge 104, as do the second portion 130 and the third portion 150. The first portion 110 is of a width W, which is typically slightly wider than a mattress width MW for which the bed covering is designed. For example, if the bed covering is for a standard queen sized mattress, which has a width MW of 60", the width W may be 96. Likewise, for a standard king-sized mattress, which as a mattress width MW of 78", the bed covering may have a width W of 110".

The width W of the first portion 110 is measured from the respective folding regions 106 and 108. While the folding regions 106 and 108 are represented by lines, it is to be understood that the folding region is the region at which the bed covering folds when the second portion 130 and the third portion 150 are folded and forms folded edges, as will be described in more detail below.

The bed cover 100 is wider than the mattress width MW so that it overhangs a mattress by an overhand distance OD. This overhang distance OD may vary for each bed covering 100, but typically it is approximately long enough to cover the sides of the mattress when the bed covering 110 is centered on the mattress along a central axis 101.

The second portion 130 extends from the first folding region 106 by an extension width W'. Likewise, the third portion 150 extends from the second folding region 108 by the extension width W'. In the implementation of FIG. 1, the width W' is one half the width W. The second portion 130 extends from the first folding region 106 of the bed covering by the extension width W and forms a first side edge 136 of the bed covering 100 that is substantially parallel to the first folding region 106. Likewise, the third portion 150 extends from the second folding region 108 of the bed covering by the extension width W and forms a second side edge 136 of the bed covering 100 that is substantially parallel to the second folding region 108.

The second portion 130 and the third portion 150 are folding portions that may be folded and unfolded along the folding regions. In particular, the second portion 130 and the third portion 150 may be unfolded during use (e.g., during sleeping) and folded when not in use (e.g., after sleep and when the bed is made). To maintain the bed covering 100 in the folded position, one or more fasteners may be used. As shown in FIG. 1, the first portion 110 includes fasteners 170-175 and 190-195, the second portion 130 includes fasteners 160-165, and the third potion 150 includes fasteners 180-185, which are spaced at respective reciprocal distances. For example, fasteners 160, 162 and 164 are spaced apart from the folding region 106 by a distance W', as are fasteners 170, 172 and 174, such that when the second portion 130 is folded over, the fasters 160, 162 and 164 come into respective juxtaposition with fasters 170, 172 and 174 and may be respectively fastened together. Fasteners 161, 163 and 165 and fasteners 171, 173 and 175 are similarly position relative to the folding region 106, only much closer to the folding region 106. The fasteners 180-185 and 190-195 are similarly positioned on the other side of the bed covering 100.

In particular, the first portion includes a first set of reciprocal fasteners 170-175 for the fasters 160-165, and a second set of reciprocal fasteners 190-195 for the fasteners 180-185. When the second and third portions 130 and 150 are folded upward and over relative to the drawing depiction, the first set of reciprocal fasteners 170-175 align with the fasters 160-165, and the second set of reciprocal fasteners 190-195 align with the fasteners 180-185. The fasteners may thus be reciprocally secured so that the bed covering 110 may be moved and positioned while the second portion 130 and the third potion 150 remain in the folded position.

Any appropriate types of fasteners may be used. For example, the fasteners 160-165 and 180-185 may be cloth ties, and the fasteners 170-175 and 190-195 may be cloth loops. Alternatively, the fasteners 160-165 and 180-185 may be buttons, and the fasteners 170-175 and 190-195 may button holes. Other fasteners, such as embedded magnets, or hook and loop fasteners may also be used.

Additionally, more or fewer fasteners than the number of fasters illustrated in FIG. 1 may be used. For example, only fasteners 160, 170, 164, 174, 180, 190, 184 and 194 may be used in some implementations. Moreover, while discrete sets are used, other types of configurations can be used. For example, the periphery of the side edges 136 and 156 may be covered with a first portion of a hook and loop fastener, e.g., a strip of hooks running the length L along the edges, and either side of the central axis 101 may be lined with a second, reciprocal portion of a hook and loop fastener, e.g., strips of loops running the length L.

When the second portion 130 and third portion 150 are secured in the respectively folded positions, being folded along the first folding region 106 and the second folding region 108, the first folding region 106 forms a first folded edge 107 running from the top edge 102 of the first potion 110 to the bottom edge 104 of the first portion 110. Likewise, the second folding region 150 forms a second folded edge 109 running from the top edge 102 of the first potion 110 to the bottom edge 104 of the first portion 110. The side edges 136 and 156 are also in juxtaposition, as illustrated in FIGS. 2 and 3.

In some implementations, when the portions 130 and 150 of the bed covering 100 are in the folded position, the dimensions of the bed covering 100 are approximately those of a standard-sized bed covering for a particular mattress size (e.g., king, queen, etc.). This is illustrated in FIG. 3. In particular, given the particular configuration of FIG. 1, the first folded edge 107 and the second folded edge 109 are separated by the width of the first portion 110, which is substantially the same as the width of a bed covering design for a mattress of a mattress width MW. Conversely, when the bed covering 110 is in use, the first portion 130 and the second portion 150 are unfastened and unfolded, increasing the dimensions of the bed covering 100 such that the first side edge 136 of the bed covering 100 and the second side edge 156 of the bed covering 110 are separated by the width W of the first region 110 and the respective extension widths W'.

FIG. 3 is a cross-sectional view of the adjustable bed covering 100 of FIG. 1 in a folded position on a mattress 200 and box spring 202. The cross section is taken at the approximate center of the bed covering 100, bisecting fasteners 162, 172, 163, 173, 182, 192, 183 and 193. As illustrated, the bed covering 110 is folded such that the second portion 130 and third portion 150 are beneath the first portion 110. However, the bed covering could be reversed such that the first portion 110 is beneath the second portion 130 and the third portion 150. FIG. 3 illustrates how the fasteners pairs help secure folds in the folding regions 106 and 108 to maintain the folded edges 107 and 109. In the implementation of FIG. 1, the top edge 102, the bottom edge 104, the first folded edge 107 and the second folded edge 109, form rectangular peripheral dimensions that correspond to a standard bed covering size for a standard size mattress. The width W is such that the first portion 110, when centered on the mattress 200, covers a top surface of the mattress, and the first folding region 106 overhangs a first side of the mattress by the overhang distance OD, and the second folding region 108 overhangs a second side of the mattress 200 opposite the first side of the mattress by the overhang distance OD.

In some implementations, the fasteners are positioned on the same side surface of the bed covering 100, e.g., the bottom side of the bed covering 100, as illustrated in FIG. 1. The fasteners may be flush with the edges of the bed covering 100, or may be spaced apart from the edges of the bed covering, e.g., one or even several inches away from the edges.

Some fasteners, however, need not be on a particular side, and instead may extend from an edge periphery. For example, fasteners 160, 170, 164, 174, 180, 190, 184 and 194 may be ties that extend from the edges, e.g., fasteners 160 and 164 extend from edge 136; 180 and 184 extend from edge 156; fasteners 170 and 190 extend from edge 102, and fasteners 174 and 194 extend from edge 104.

In yet another implementation, the first portion 110 may be without fasteners, and fasteners 160, 162 and 164 respectively fasten to fasteners 180, 182 and 184 when the bed covering 100 is in the folded position. In still yet another implementation, the first portion 110 may be a set of three fasteners that are loops, e.g., a single cloth loop to replace fasteners 170 and 190, another single cloth loop to replace fasteners 172 and 192, and another single cloth loop to replace fasteners 174 and 194. Fasteners 160 and 180 may thus fasten to the fastener that is present instead of fasteners 170 and 190, and so on for fasteners 162 and 182, and fasteners 164 and 184.

Figure 4:
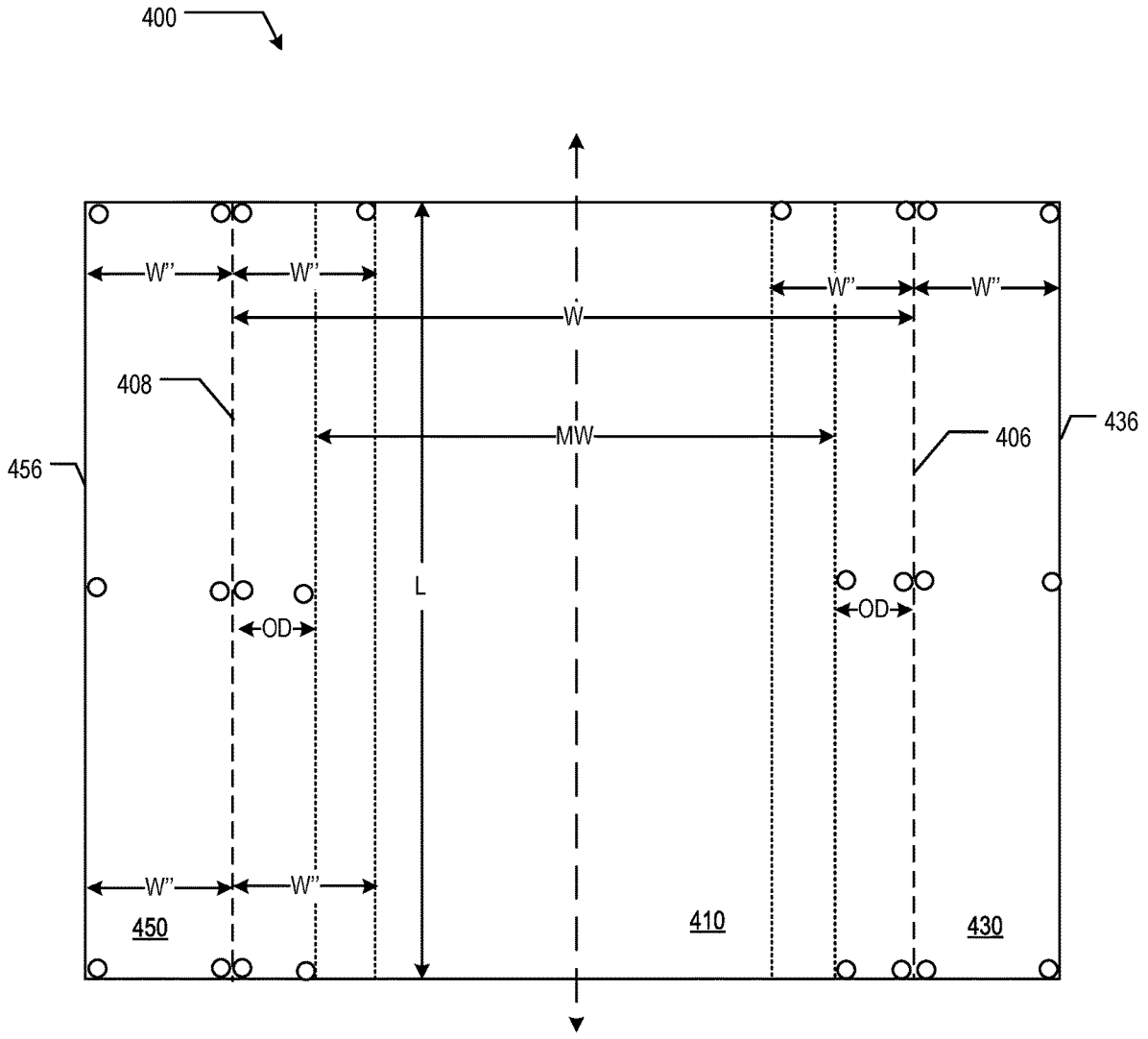
FIG. 4 is a bottom view of another implementation of the adjustable bed covering.
Figure 5:
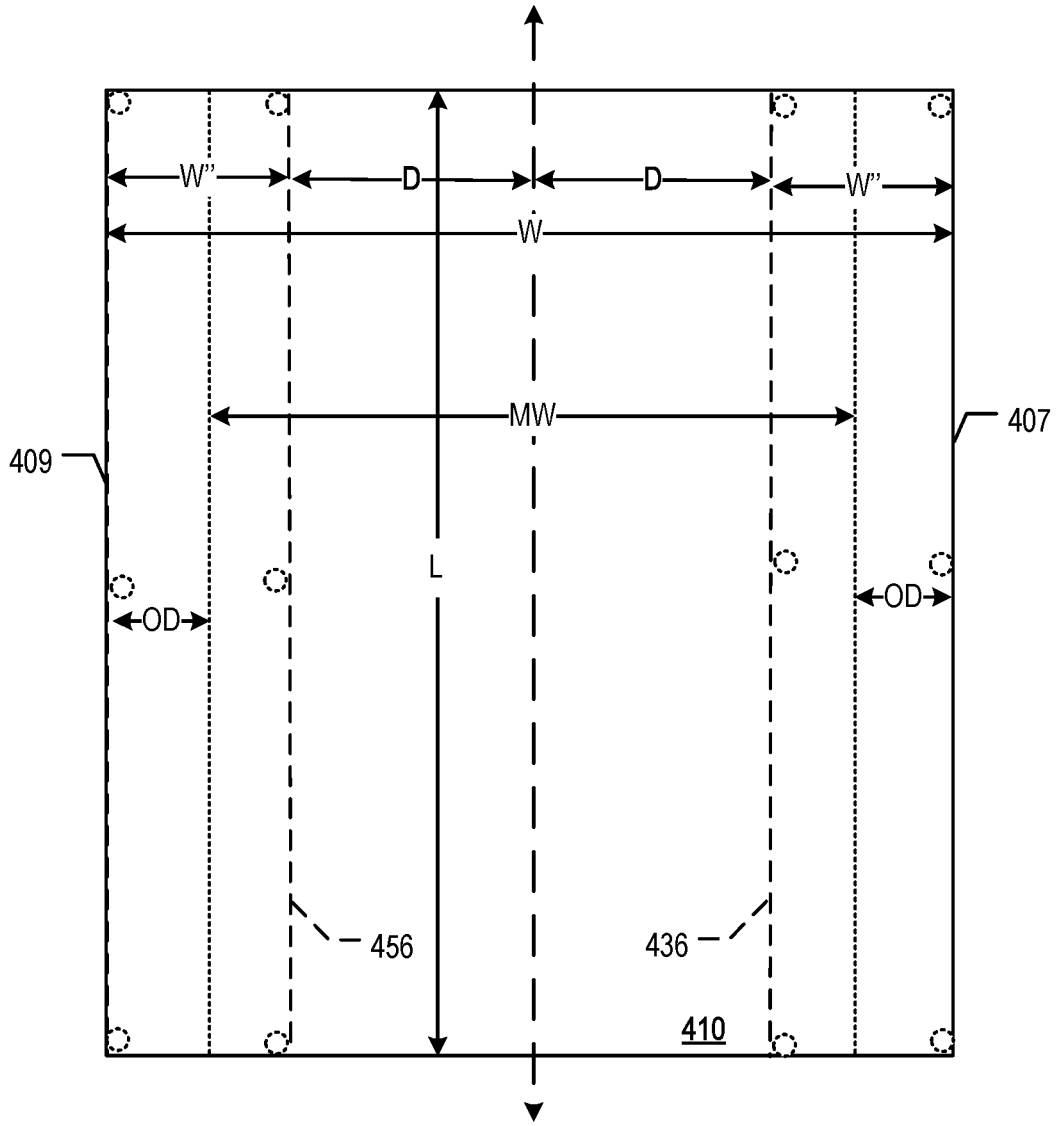
FIG. 5 a top view of the adjustable bed covering of FIG. 4, when the adjustable bed covering is in a folded position.
Figure 6:
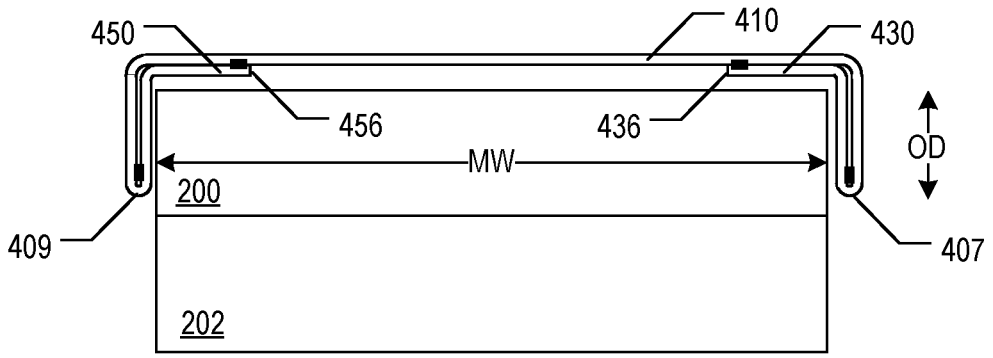
FIG. 6 is a cross-sectional view of the adjustable bed covering of FIG. 5 in a folded position on a mattress and box spring.

In the implementation of FIG. 2, the extension widths W' are substantially one-half the width W. However, the extension widths can also be less than the width W. One example implementation in which the extension width is less than the width W of the first portion is shown in FIGS. 4, 5 and 6. Here the bed covering 400 has a first region 410 from which respective second and third regions 430 and 450 extend from folding regions 406 and 408. The second and third regions 430 and 450 are each of an extension width W", which is less than one-half of the width W of the first region 410.

Accordingly, when the first portion 430 and the second portion 450 are in the folded position, the side edges 436 and 456 are spaced apart from a central axis of the bed covering 400 by a distance D, which is substantially equal to W/2−W". This is illustrated in FIG. 5, which is a top view of the bed covering 400 in the folded position, and where the fasteners and edges 436 and 456 are below the first portion 410, as indicated by the phantom detail.

FIG. 6 is a cross-sectional view of the adjustable bed covering 400 of FIG. 4 in a folded position on a mattress 200 and box spring 202. The fasteners are positioned such that in the folded position, the bed covering 400 has the approximate peripheral dimensions of a standard sized bed covering, as indicated by the folded edges 407 and 409 overhanging by the overhand distance OD.

Figure 7:
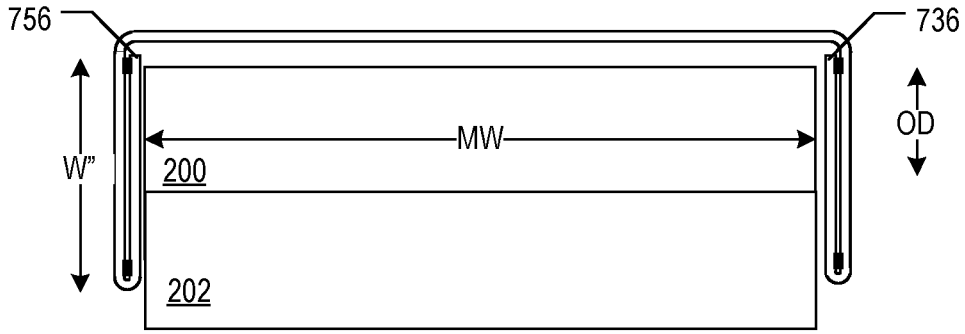
FIG. 7 is a cross-sectional view of yet another adjustable bed covering in a folded position on a mattress and box spring.

The fasteners need not however, be positioned so that folded edges overhang at a distance coincident with an overhang distance for a standard bed covering size. For example, FIG. 7 is a cross-sectional view of another implementation of an adjustable bed covering 700 in a folded position on a mattress 200 and box spring 202. Here the fasteners are positioned such that the side edges 736 and 756 do not lay on top of the surface of the mattress 200 when the bed covering is in the folded position.

More generally, the extension width of the second and third portions of the bed covering may vary from approximately the overhang distance to approximately one half the width of the first portion (or even be wider than one half the width of the first portion so that even the second portion and third portion would overlap when the bed covering is in the folded position.

The folding regions need not have special structural component; for example, the folding regions may be just a portion of a duvet at which a fold is made when the folding portions (second portion or third portion of the bed covering) is folded. Alternatively, the folding region may be coincident with a seam or some other textile structure that facilitates folding.

The bed covering may be a comforter, a duvet, or any other appropriate bed covering.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular implementations of the subject matter have been described. Other implementations are within the scope of the following claims.

What is claimed is:

1. A bed covering, comprising:

a first portion defining a top edge, a bottom edge, a first folding region and a second folding region, wherein:

a length of the first portion is measured from the top edge to the bottom edge;

a width of the first portion is measured from the first folding region to the second folding region; and a second portion that has a top edge and bottom edge respectively extending from the top edge and bottom edge of the first portion, and that extends from the first folding region of the bed covering by an extension width and forms a first side edge of the bed covering that is substantially parallel to the first folding region of the bed covering;

a third portion that has a top edge and bottom edge respectively extending from the top edge and bottom edge of the first portion, and that extends from the second folding region of the bed covering by the extension width and forms a second side edge of the bed covering that is substantially parallel to the second folding region of the bed covering;

wherein at least the second portion and third portions include fasteners that can secure the second portion and third portion in respectively folded positions along the first folding region and the second folding region so that the first folding region forms a first folded edge running from the top edge of the first potion to the bottom edge of the first portion, and the second folding region forms a second folded edge running from the top edge of the first portion to the bottom edge of the first portion, and wherein the first folded edge and the second folded edge are separated by the width of the first portion;

wherein:

the first portion includes:

a first top fastener along the top edge and spaced apart from the first folding region by a first distance;

a second top fastener along the top edge and spaced apart from the second folding region by the first distance;

a first bottom fastener along the bottom edge and spaced apart from the first folding region by the first distance; and a second bottom fastener along the bottom edge and spaced apart from the second folding region by the first distance;

the second portion includes:

a third top fastener along the top edge and spaced apart from the first folding region by the first distance; and a third bottom fastener along the bottom edge and spaced apart from the first folding region by the first distance; and the third portion includes:

a fourth top fastener along the top edge and spaced apart from the second folding region by the first distance; and a fourth bottom fastener along the bottom edge and spaced apart from the second folding region by the first distance; and when the second portion is folded along the first folding region, the first top fastener and the third top fastener come into juxtaposition and can be fastened together, and the first bottom fastener and the third bottom fastener come into juxtaposition and can be fastened together; and when the third portion is folded along the second folding region the second top fastener and the fourth top fastener come into juxtaposition and can be fastened together, and the second bottom fastener and the fourth bottom fastener come into juxtaposition and can be fastened together.

2. The bed covering of claim 1, wherein:

the top edge, the bottom edge, the first folding region and the second folding region form rectangular peripheral dimensions that correspond to a standard bed covering size for a standard mattress size of a mattress; and the width is such that the first portion, when centered on the mattress, covers a top surface of the mattress, and the first folding region overhangs a first side of the mattress by an overhang distance, and the second folding region that overhangs a second side of the mattress opposite the first side of the mattress by the overhang distance.

3. The bed covering of claim 2, wherein the extension width of each second and third portions is approximately the overhang distance.

4. The bed covering of claim 1, wherein:

when the second portion is folded along the first folding region and the first and third top fasteners are fastened together and the first and third bottom fasteners are fastened together, the first folding region forms a first folded edge running from the top edge of the first potion to the bottom edge of the first portion; and when the third portion is folded along the second folding region and the second and fourth top fasteners are fastened together and the second and fourth bottom fasteners are fastened together, the second folding region forms a second folded edge running from the top edge of the first potion to the bottom edge of the first portion;

wherein the first folded edge and the second folded edge are separated by the width of the first portion.

5. The bed covering of claim 4, wherein:

when the second portion is unfolded along the first folding region, and the third portion is unfolded along the second folding region, the first side edge of the bed cover and the second side edge of the bed covering are separated by the width of the first region and the respective extension widths.

6. The bed covering of claim 1, wherein the first top fastener, second top fastener, third top fastener, fourth top fastener, first bottom fastener, second bottom fastener, third bottom fastener and fourth bottom fastener are each on a same side surface of the bed covering.

7. The bed covering of claim 1, wherein the extension width of each second and third portions is less than one half the width of the first portion.

8. The bed covering of claim 1, wherein the bed covering is a duvet.

9. The bed covering of claim 1, wherein the bed covering is a comforter.

10. A bed covering, comprising:

a first portion defining a top edge, a bottom edge, a first folding region and a second folding region, wherein:

a length of the first portion is measured from the top edge to the bottom edge;

a width of the first portion is measured from the first folding region to the second folding region; and a second portion that has a top edge and bottom edge respectively extending from the top edge and bottom edge of the first portion, and that extends from the first folding region of the bed covering by an extension width and forms a first side edge of the bed covering that is substantially parallel to the first folding region of the bed covering;

a third portion that has a top edge and bottom edge respectively extending from the top edge and bottom edge of the first portion, and that extends from the second folding region of the bed covering by the extension width and forms a second side edge of the bed covering that is substantially parallel to the second folding region of the bed covering;

wherein at least the second portion and third portions include fasteners that can secure the second portion and third portion in respectively folded positions along the first folding region and the second folding region so that the first folding region forms a first folded edge running from the top edge of the first potion to the bottom edge of the first portion, and the second folding region forms a second folded edge running from the top edge of the first portion to the bottom edge of the first portion, and wherein the first folded edge and the second folded edge are separated by the width of the first portion;

wherein the extension width of each second and third portions is approximately one half the width of the first portion.

11. A bed covering, comprising:

a first portion defining a top edge, a bottom edge, a first folding region and a second folding region, wherein:

a length of the first portion is measured from the top edge to the bottom edge;

a width of the first portion is measured from the first folding region to the second folding region; and a second portion that has a top edge and bottom edge respectively extending from the top edge and bottom edge of the first portion, and that extends from the first folding region of the bed covering by an extension width and forms a first side edge of the bed covering that is substantially parallel to the first folding region of the bed covering;

a third portion that has a top edge and bottom edge respectively extending from the top edge and bottom edge of the first portion, and that extends from the second folding region of the bed covering by the extension width and forms a second side edge of the bed covering that is substantially parallel to the second folding region of the bed covering;

wherein at least the second portion and third portions include fasteners that can secure the second portion and third portion in respectively folded positions along the first folding region and the second folding region so that the first folding region forms a first folded edge running from the top edge of the first potion to the bottom edge of the first portion, and the second folding region forms a second folded edge running from the top edge of the first portion to the bottom edge of the first portion, and wherein the first folded edge and the second folded edge are separated by the width of the first portion;

wherein the extension width of each second and third portions is less than one half the width of the first portion.

12. A bed covering, comprising:

a first portion defining a top edge, a bottom edge, a first folding region and a second folding region, wherein:

a length of the first portion is measured from the top edge to the bottom edge;

a width of the first portion is measured from the first folding region to the second folding region; and a second portion that has a top edge and bottom edge respectively extending from the top edge and bottom edge of the first portion, and that extends from the first folding region of the bed covering by an extension width and forms a first side edge of the bed covering that is substantially parallel to the first folding region of the bed covering;

a third portion that has a top edge and bottom edge respectively extending from the top edge and bottom edge of the first portion, and that extends from the second folding region of the bed covering by the extension width and forms a second side edge of the bed covering that is substantially parallel to the second folding region of the bed covering;

wherein at least the second portion and third portions include fasteners that can secure the second portion and third portion in respectively folded positions along the first folding region and the second folding region so that the first folding region forms a first folded edge running from the top edge of the first potion to the bottom edge of the first portion, and the second folding region forms a second folded edge running from the top edge of the first portion to the bottom edge of the first portion, and wherein the first folded edge and the second folded edge are separated by the width of the first portion;

wherein:

the second portion includes:

a first top fastener along the first side edge and spaced apart from the top edge by a first distance; and a first bottom fastener along the first side edge and spaced apart from the bottom edge by the first distance; and the third portion includes:

a second top fastener along the second side edge and spaced apart from the top surface by the first distance; and a second bottom fastener along the second side edge and spaced apart from the bottom surface by the first distance; and the extension width of the second portion and third portion is one half the width of the first portion so that when the second portion is folded along the first folding region and the third portion is folded along the second folding region the first top fastener and the second top fastener come into juxtaposition and can be fastened together, and the first bottom fastener and the second bottom fastener come into juxtaposition and can be fastened together.

* * * * *